US012129661B2

(12) United States Patent
Naeyaert

(10) Patent No.: US 12,129,661 B2
(45) Date of Patent: Oct. 29, 2024

(54) FLOOR ELEMENT AND METHOD FOR MANUFACTURING FLOOR ELEMENTS

(71) Applicant: FLOORING INDUSTRIES LIMITED, SARL, Bertrange (LU)

(72) Inventor: Christophe Naeyaert, Jabbeke (BE)

(73) Assignee: UNILIN BV, Wielsbeke (BE)

( * ) Notice: Subject to any disclaimer, the term of this patent is extended or adjusted under 35 U.S.C. 154(b) by 201 days.

(21) Appl. No.: 17/782,705

(22) PCT Filed: Nov. 10, 2020

(86) PCT No.: PCT/IB2020/060574
§ 371 (c)(1),
(2) Date: Jun. 6, 2022

(87) PCT Pub. No.: WO2021/116792
PCT Pub. Date: Jun. 17, 2021

(65) Prior Publication Data
US 2023/0010303 A1 Jan. 12, 2023

(30) Foreign Application Priority Data
Dec. 10, 2019 (BE) ..... 2019/5883

(51) Int. Cl.
*E04F 15/02* (2006.01)
*E04F 15/10* (2006.01)

(52) U.S. Cl.
CPC ..... *E04F 15/02038* (2013.01); *E04F 15/105* (2013.01); *E04F 2201/0146* (2013.01);
(Continued)

(58) Field of Classification Search
CPC ..... E04F 15/02038; E04F 15/105; E04F 2201/0146; E04F 2201/0153;
(Continued)

(56) References Cited

U.S. PATENT DOCUMENTS 8,925,275 B2 * 1/2015 Meersseman ..... E04F 15/102 52/592.1
9,771,721 B2 * 9/2017 Cappelle ..... B32B 27/304
(Continued)

FOREIGN PATENT DOCUMENTS

CN 104160101 A 11/2014
CN 107619513 A 1/2018
(Continued)

OTHER PUBLICATIONS

Belgian Search Report from corresponding Belgian Application No. 201905883, Aug. 14, 2020.
(Continued)

*Primary Examiner* — Rodney Mintz
(74) *Attorney, Agent, or Firm* — Workman Nydegger

(57) ABSTRACT

A floor element includes a decorative top layer on a polymer substrate. The sides of the floor element have a profile along a section with a surface at right angles to the decorative top layer. The floor panel is provided with a water-repellent coating on at least one side. For each side and along the entire length of the side, at least a part of the profile is coated with a water-repellent coating.

24 Claims, 2 Drawing Sheets

(52) U.S. Cl.
CPC . *E04F 2201/0153* (2013.01); *E04F 2201/023* (2013.01); *E04F 2201/042* (2013.01); *E04F 2201/043* (2013.01)

(58) Field of Classification Search
CPC ..... E04F 2201/023; E04F 2201/042; E04F 2201/043; E04F 15/02033; E04F 15/02188; E04F 2201/0138; E04F 15/043
See application file for complete search history.

(56) References Cited

U.S. PATENT DOCUMENTS

| | | | | |
|---|---|---|---|---|
| 11,454,036 | B1 * | 9/2022 | Morris | E04F 15/02033 |
| 2009/0260313 | A1 * | 10/2009 | Segaert | B44C 5/043 52/592.1 |
| 2013/0104485 | A1 | 5/2013 | Meersseman et al. | |
| 2015/0337540 | A1 | 11/2015 | Cappelle | |

FOREIGN PATENT DOCUMENTS

| | | | |
|---|---|---|---|
| EP | 1026341 | B1 | 8/2003 |
| WO | 2007113676 | A2 | 10/2007 |
| WO | 2012004700 | A2 | 1/2012 |
| WO | 2016182896 | A1 | 11/2016 |
| WO | 2018087637 | A1 | 5/2018 |
| WO | 2019135141 | A1 | 7/2019 |

OTHER PUBLICATIONS

International Search Report from corresponding PCT Application No. PCT/IB2020/060574, Jan. 19, 2021.

* cited by examiner

FLOOR ELEMENT AND METHOD FOR MANUFACTURING FLOOR ELEMENTS

BACKGROUND

The invention relates to a floor element comprising a polymer substrate, wherein this floor panel is provided with coupling means along its sides, and to methods for manufacturing floor elements comprising such a polymer substrate and coupling means.

Floor elements comprising a polymer substrate and provided with coupling means along their sides are known, for example from WO 2018/087637. Such floor panels are deemed to be waterproof. The coupling means are, for example, so-called click-fit systems, tongue-and-groove systems or so-called "fold down" systems. These coupling means are intended to keep adjacent floor elements coupled together. However, the joint which is brought about by means of the prior-art coupling means may be water-permeable. This may result in water ending up under the floor covering which is composed of such floor panels and eventually to fungal growth.

The coupling means of the floor elements known from WO'637 may lead to defects or other undesirable effects in the floor covering composed of such floor elements when they are subjected to changing thermal conditions, for example if the floor is partly or completely exposed to the sun, which causes the temperature of the floor, i.e. of the floor elements which are coupled together, to rise. The dimensional changes of the floor elements may result in a section of the floor being raised, connections between floor elements becoming detached and/or the formation of gaps between floor elements which have been coupled together. These problems may then in turn result in an increased water permeability of the joints.

It is known from CN 107619513 to make such a floor element more resistant to fungal growth by adding fungus-resistant additives to the material from which the floor panel is composed.

It is known from WO 2016/182896 to treat the edges of water-sensitive floor panels with an impregnating agent and/or a sealant. Such a treatment prevents any moisture from penetrating into the floor panel.

It is an object of the invention firstly to provide alternative floor elements. According to various preferred embodiments, floor elements are provided which offer a solution to one or more of the problems of prior-art floor elements. In particular, floor elements which allow expansion and at the same time have watertight joints are aimed at.

According to a first independent aspect of the invention, a floor element is provided comprising a decorative top layer on a polymer substrate, wherein the sides of the floor element have a profile along a section with a surface at right angles to the decorative top layer, which is characterized by the fact that the floor panel is provided with a water-repellent coating on at least one side, and wherein, preferably, for each side and along the entire length of each respective side, at least a part of the profile is coated with a water-repellent coating. It is counter-intuitive to provide a floor element comprising a polymer substrate with a water-repellent coating. The reason for this is that the material of the floor element as such is already considered to be waterproof and further protection seems unnecessary. Nevertheless, the present inventors have realized that even with floor elements comprising a polymer substrate, the use of a water-repellent coating may be advantageous to keep any moisture out of the joint, in such a way that the risk of moisture collecting under the floor covering and causing fungus to grow can be minimized. A water-repellent coating may be and remain effective with normal joint openings which result from dimensional expansion.

Optionally, the entire profile of some or each of the sides of the floor element are coated with a water-repellent coating.

The sides of the floor element are at least partly, and preferably only partly, coated, that is to say, at least a part of the profile is provided with a water-repellent coating along preferably the entire length of the side. Thus, between the first and second end of the side, there is preferably an uninterrupted strip of side present which is coated with a water-repellent coating.

It is clear that the water-repellent coating which is used in the context of the invention in equilibrium preferably has a contact angle with water which is greater than 100°, wherein this contact angle is measured by the water droplet. Better still, the contact angle is 125° or greater. In this way, moisture forms into a droplet shape when it comes into contact with the water-repellent coating. Since water droplets have a diameter of, on average, at least 0.1 mm, they can no longer move through small passages. Thus, for example, when the water-repellent coating is applied at least directly under a top edge of the floor elements, moisture is able to assume this state on the joint, formed by, inter alia, the respective top edge, between at least two such floor elements which have been coupled together. In this way, the moisture will not be able to penetrate any gaps at the location of the joint. The reason for this is that such gaps, if present, are usually smaller than 0.1 mm. In accordance with current standards, a maximum gap of 0.2 mm is still acceptable, which results in dedicated manufacturers who want to apply a safety margin using a far lower number.

According to some embodiments, the water-repellent coating may comprise epoxy resin, fluoride-functionalized epoxy resin, fluoropolymers, fluorocopolymers, fluoride-functionalized acrylate and/or combinations thereof.

According to some embodiments, the water-repellent coating may comprise fluoropolymers and/or fluorocopolymers.

The water-repellent coating is preferably applied at a weight per unit area of more than 0.25 g/m$^2$, preferably more than 0.5 g/m$^2$. The water-repellent coating is preferably applied at a weight per unit area of less than 5 g/m$^2$, preferably less than 4 g/m$^2$.

According to some embodiments, the substrate may comprise polyvinyl chloride.

Preferably, the substrate consists of polyvinyl chloride (PVC). In addition to polymer of vinyl chloride monomer, this PVC may also comprise copolymer composed of vinyl acetate and vinyl chloride. The PVC used typically has a K value of between 50 and 90, preferably between 55 and 70.

Alternative polymers for the substrate are polypropylene and polyethylene, polyurethane, polyester or polyamide. Polyethylene terephthalate may be used as the polyester.

The substrate may comprise soft, semi-soft or hard polymer. The expression soft polymer (for example soft PVC) is understood to mean a polymer which comprises 40 or more than 40 phr of plasticizers. The expression semi-hard or semi-soft polymers is understood to mean a polymer which comprises between 10 and 40 phr of plasticizers where hard polymer comprises less than or exactly 10 phr of plasticizer.

The substrate may also consist of several layers or sections with different polymers. Preferably, the substrate comprises a substrate section under, and preferably directly under, the decorative top layer which is softer than a substrate section situated underneath it. Thus, for example, the softer substrate section may comprise PVC with a higher plasticizer content than a substrate section situated underneath it, preferably at least 5 phr higher. Thus, for example, the softer substrate section may comprise soft PVC, whereas the substrate section situated underneath it is formed from semi-hard or hard PVC. The softer substrate section may result in a lower noise production when the floor covering is being walked on and in more distinct possibilities for the structures of the top layer, while the less soft layers provided a more stable floor element.

Within the context of the present invention, phr is understood to mean "parts per hundred resin", i.e. the number of parts by weight of the component per hundred parts by weight of polymer.

In general, in the context of the present invention, plasticizers are inter alia esters of carboxylic acids (for example esters of phthalic acid, isophthalic or terephthalic acid, trimellitic acid and adipic acid), for example diisononyl phthalate (DINP), dioctyl terephthalate (DOTP), diisononyl cyclohexane-1,2-dicarboxylate (DINCH), esters of phosphoric acid, for example triaryl or trialkylaryl phosphates, for example tricresyl phosphate, optionally chlorinated carbohydrates, ethers, polyesters, polyglycols, sulphonamides, or combinations thereof.

In the case of a rigid substrate made of PVC, the substrate comprises hard or semi-hard PVC which, in total, may be between 2 mm and 6 mm thick, for example between 3 mm and 4.5 mm. Possibly one or more reinforcing layers are incorporated in or applied to this substrate. Thus, for example, one of the reinforcing layers may be provided on the bottom side of the floor element. For rigid substrates made of PVC, the substrate will thus mainly comprise hard or semi-soft PVC. The substrate may comprise one or more, for example two, reinforcing layers which are embedded on or between the hard or semi-soft PVC layer or layers. The reinforcing layer or layers comprise a fiber nonwoven, often a glass fiber nonwoven, in which the hard or semi-hard PVC is partly or completely impregnated. Glass fiber nonwovens having a weight per unit area of between 25 and 150 g/m$^2$ may be used, for example nonwovens having a weight per unit area of between 30 and 75 g/m$^2$. Part of the PVC may be present in the substrate above the uppermost of the one or more reinforcing layers, for example glass fiber nonwovens. The thickness of this PVC layer above the uppermost of the one or more reinforcing layers may be between 0.3 mm and 0.7 mm. The thickness of the PVC layer between the uppermost and bottom reinforcing layers, in case several reinforcing layers are provided, may vary between, for example, 2 and 4 mm. A part of the PVC may be present in the substrate under the bottommost of the one or more reinforcing layers. The thickness of this PVC layer under the bottommost of the one or more reinforcing layers may be between 0.3 mm and 0.7 mm. In case one reinforcing layer is provided, this layer may be situated centrically or eccentrically from the layer of hard or semi-hard PVC.

The hard or semi-hard PVC preferably comprises up to 15 phr of plasticizer, most preferably between 7 and 10 phr. The hard or semi-hard PVC preferably comprises up to 70 wt % of fillers (compared to the entire weight of the PVC composition).

For flexible substrates made of PVC, the substrate will comprise mainly soft PVC or semi-hard PVC. The substrate may comprise one or more, for example two, reinforcing layers which are embedded on or between the soft or semi-soft PVC layer or layers. The reinforcing layer or layers comprise a fiber nonwoven, often a glass fiber nonwoven, in which the soft or semi-hard PVC is partly or completely impregnated. Glass fiber nonwovens having a weight per unit area of between 25 and 150 g/m$^2$ may be used, for example nonwovens having a weight per unit area of between 30 and 75 g/m$^2$. In some embodiments, the substrate comprises a reinforcing layer comprising a glass fiber nonwoven, which will form that side of the substrate which comes into contact with the top layer, i.e. into contact with the decorative layer.

The substrate comprises soft or semi-hard PVC which is, in total, between 1.2 mm and 6 mm thick, for example between 1.2 mm and 4.5 mm, in which the reinforcing layers are incorporated or on which they are applied. A part of the PVC may be present in the substrate above the uppermost of the one or more reinforcing layers, for example glass fiber nonwovens. The thickness of this PVC layer above the uppermost of the one or more reinforcing layers may be between 0.3 mm and 2 mm. The thickness of the PVC layer between the uppermost and bottommost reinforcing layers, in case several reinforcing layers are provided, may vary between, for example, 2 and 4 mm. A part of the PVC may be present in the substrate under the bottommost of the one or more reinforcing layers. The thickness of this PVC layer under the bottommost of the one or more glass fiber nonwovens may be between 0.75 mm and 3 mm. In case one reinforcing layer is provided, this layer may be situated centrically or eccentrically from the layer of soft PVC. The soft PVC or semi-hard PVC comprises preferably more than 30 phr of plasticizer. The soft or semi-hard PVC preferably comprises up to 65 wt % of fillers (relative to the entire weight of the PVC composition).

The substrate may be rigid or flexible, depending on which polymer was used.

In the context of the present invention, flexible means that the products, when a strip of product has been clamped to one side and the other, opposite side can hang freely, will sag under their own weight. Flexible therefore also means that a product will sag more than 35 centimeters per meter of projecting length under its own weight. Preferably, a product will sag more than 40 centimeters per meter of projecting length under its own weight, such as more than 50 centimeters per meter of projecting length. Rigid or stiff on the other hand means that a product will sag less than 35 centimeters per meter of projecting length under its own weight.

The thickness of the substrate, which may as such consist of different layers, is preferably between 3 and 10 mm, most preferably between 3 and 8 mm.

The substrate may contain one or more reinforcing elements or layers, for example one or more layers of glass fiber nonwoven or glass fiber woven.

The substrate may be foamed or non-foamed. If it is foamed, the substrate or a portion thereof preferably has a closed foam structure. Foaming may be performed by chemical foaming, i.e. by adding solid or liquid means (also referred to as blowing agents) which, under the action of the increased temperature, will convert to gas and consequently form open or closed foam structures. It may also be performed by means of mechanical foaming, i.e. the addition of gas or air to the liquid form of the material. It may also be turned into a foam by adding fillers, for example spherical particles filled with blowing agent which expand at an increased temperature, or adding already expanded spherical particles.

The substrate preferably has a density of between 1.8 and 2.1 kg/l in the non-foamed form, for example between 1.85 and 2 kg/l. The substrate of the respective foamed portion thereof preferably has a density of between 0.8 and 1.8 kg/l, such as between 0.85 and 1.5 kg/1 in the foamed form.

The substrate may comprise fillers, such as, inter alia, glass fibers, calcium hydroxide (slaked lime), calcium carbonate and calcium hydrogen carbonate, and/or $CaMg(CO_3)_2$, talcum, or also be lightweight fillers, such as hollow microsphere (Expancel). The abovementioned weight percentage (wt %) is expressed as the weight of the filler relative to the weight of the polymer, optionally PVC, in which the filler is comprised. The amount of fillers is preferably between 100 and 300 phr, for example between 150 and 250 phr.

The substrate may furthermore comprise large numbers of other substances, such as pigments and colorants, preservatives, anti-fungi, thermal stabilizers, UV-stabilizers, blowing agents, viscosity control agents, and the like.

According to some embodiments, one or more of the sides may have a straight profile or a profile which is free from sections which extend beyond the associated top edge in the horizontal direction, namely a profile which only consists of profile sections which are situated under the associated panel surface in the vertical direction, or a profile which is complementary to a profile of an opposite sides without the complementary shape resulting in a mutual locking or coupling.

The respective embodiments are intended in particular for so-called glue-down or loose-lay floor elements which are fitted by gluing them to the floor or by loosely laying them on a floor, respectively.

A straight profile means that the profile of the side runs along a straight line, between the transition point between the top side (provided by the decorative top layer) and the side, and the transition point between the bottom side of the floor element and this side. This may be, but does not have to be, a straight line which is substantially at right angles to the decorative surface.

According to some embodiments, one or more of the sides may have a non-straight profile.

Although straight sides are possible, the sides may have a curved profile or a profile which comprises coupling means, for example in order to offer the possibility to couple two floor elements together laterally. The profiles possibly extend from the top side of the floor element (formed by the decorative top layer) to the bottom side of the floor element. An optionally beveled edge at the location of the transition from the top layer to the side may form part of this non-straight profile.

A non-straight profile runs between the transition point between the top side (provided by the decorative top layer) and the side, and the transition point between the bottom side of the floor element and this side. Preferably, this profile is composed of successive sections along the profile, which sections may be curved or straight and wherein the orientation of each of the sections may run at right angles to, obliquely or parallel to the top side of the floor element.

The floor elements, both those with a flexible and a rigid substrate, often have a limited surface dimension. They may be configured as "boards" or "tiles", being preferably rectangular or square surfaces having a width between 8 and 80 cm and a length between 50 and 200 cm, preferably between 1.0 and 1.6 m long and between 0.12 and 0.6 or between 0.12 and 0.5 m wide.

According to some embodiments, the floor element may be substantially rectangular or square, and wherein at least a first pair of two opposite sides have a non-straight profile and/or are provided with a profile which comprises coupling means. According to some embodiments, the first pair of two profiles may together form a set of complementary coupling means to couple two adjacent floor elements to each other.

According to some embodiments, the floor element may be substantially rectangular or square, wherein two pairs of two opposite sides have a non-straight profile and/or are provided with a profile which comprises coupling means. According to some embodiments, it may be true for both pairs that the two profiles of mutually opposite sides together form a set of complementary coupling means to couple two adjacent floor elements to each other.

Optionally, two sides, one of each of the pairs of sides, can also be coupled to each other in order thus to be able to form a herringbone laying pattern for the floor elements.

This coupling means may be any kind of coupling means known from the prior art, for example tongue-and-groove coupling means, coupling means comprising click-fit systems, coupling means comprising fold-down systems, coupling means comprising rotating profiles and the like.

According to some embodiments, the cooperating profiles of the coupling means may each have at least a section which adjoin each other during coupling, either by means of contact or with an intermediate space of 0.15 mm or less, so that they are also considered to be adjoining each other from a practical point of view. Preferably, the cooperating profiles have at least one such section at the location of the top edge. This is understood to mean at the location of the side edge of the top layer or at the location of the side edge of the bottom of a possibly lowered edge region, such as a beveled edge or such as a straight chamfer, for example in order to imitate a cement groove.

According to some embodiments, at least the one or more adjoining sections may be provided with the water-repellent coating. Preferably, at least the possibly adjoining section is provided with the water-repellent coating at the location of the top edge.

Preferably, the adjoining, or practically adjoining, section is provided near the top edge on a substrate portion which is softer than a substrate section located underneath. Thus, for example, the softer substrate section may comprise PVC with a higher plasticizer content than a substrate section located underneath, preferably at least 5 phr higher. Thus, for example, the softer substrate section may comprise soft PVC, whereas the substrate section located underneath is made of semi-hard or hard PVC. By means of such a section, it is possible to achieve a degree of compression upon contact, in such a way that an even better resistance to seeping through is achieved, while any dimensional expansion does not necessarily have to lead to so-called "peaking". "Peaking" is a phenomenon in which the top edges of the floor element are pushed slightly out of the floor surface.

As has already been mentioned, a compressive stress is produced in the coupled position, preferably on the adjoining section at the location of the top edge. This may be achieved, for example, by dimensioning the contours of the coupling means in such a way that they overlap, at least at the location of this section. Such a compressive stress is also known by the name of prestress and is described, for example, in EP 1 026 341 B1.

It was surprising that providing the water-repellent coating offers a solution for two conflicting requirements. In general, the sections of the profiles may be clamped against one another under a prestress or just adjoin each other or be joined very tightly. On the one hand, the coupling means have to be configured such that they do not allow water through. Until now, this was typically the aim when providing sufficient surfaces in the profiles which press against each other at a prestress in the coupling means. However, this prestress to a certain degree reduces the possibility of the floor elements moving with respect to each other in order to allow the floor elements to expand and to shrink on account of the changing temperatures. In practice, it is difficult to find the right balance to satisfy both requirements. The requirements for accurately dimensioning the profiles is so high and in practice hardly achievable, to provide both watertight systems and a sufficient freedom of movement.

By providing a water-repellent coating along at least some or along all of the profiles used to provide coupling means, even on a water-resistant polymer substrate which itself might possibly have slightly water-repellent properties, the seeping through of water into the coupling means is prevented, while a lower or no prestress can be used between the profiles which provide the coupling means. In this way, movement of the floor elements with respect to each other as a result of temperature can be allowed to a sufficient degree. The amount of prestress, if there has to be one, becomes less critical if such water-repellent coatings are applied. Both a sufficient degree of watertightness and freedom of movement can be achieved with much less accurate tolerance limits with regard to the configuration of the profiles.

According to some embodiments, at least one of the sides may be provided with at least a beveled edge at the location of the transition from the top layer to the side. According to some embodiments, the coating may be applied along the beveled edge. According to some embodiments, it may be along a section of the profile adjacent to the beveled edge.

According to some embodiments, the coating may be applied along a section of the profile, which section is oriented at right angles to or obliquely to the top surface of the floor element.

The decorative top layer of the floor element may be configured in different ways. Thus, the decorative top layer may comprise at least a layer of wood veneer.

According to some embodiments, the decorative top layer at least comprises a layer of wood veneer, at least the sections of the profiles of the sides provided by this layer of wood veneer is coated with the water-repellent coating.

An additional advantage of applying the coating to this section is the fact that water is prevented from penetrating between the wood fibers of this veneer layer.

The thickness of the veneer layer is preferably under 2.5 mm, and most preferably between 0.3 and 0.6 mm. The top side of the veneer layer may, but does not have to, be finished further, for example may be given a finishing lacquer coat.

The decorative top layer of the floor element may also consist of a decor layer, typically a hard PVC film which is provided with a pattern, for example printed, on which a wear layer, for example made of soft PVC, is provided, on which there is itself applied a scratch-resistant coating (for example a UV-curing PU coating). Under the decor layer there may possibly still be a further soft polymer layer, for example soft PVC, via which the top layer can bond to the substrate.

According to a second independent aspect of the invention, a method for manufacturing floor elements is provided, comprising the following steps:

providing a rectangular or square polymer substrate provided with a decorative top layer;

providing the profiles of the sides of the rectangular polymer substrate with a solvent-based cover layer, furthermore comprising at least one water-repellent component;

removing the solvent from the solvent-based cover layer until a water-repellent coating is obtained.

The method of the second aspect is ideally suited for use in the manufacturing of floor elements having the characterizing features of the first aspect and/or the preferred embodiments thereof.

The removal may comprise a drying step or an evaporating step. Preferably, drying or evaporating takes place in air. However, the use of a drying step using a heating step, for example by means of IR radiation, is not excluded.

According to some embodiments, the water-repellent components may comprise epoxy resin and/or fluoride-functionalized epoxy resin and/or fluoropolymers and/or fluorocopolymers and/or fluoride-functionalized acrylate.

Solvents which may form part of the solvent-based cover layer may be selected from the group consisting of water, butyl acetate, propyl acetate, such as 3-methoxy-3-methyl-1-butyl acetate (MMB-AC) or 1-methoxy-propyl acetate (MPA), a dibasic ester (DBE), a (di-)ether glycol, for example dipropylene glycol dimethyl ether, a benzoate ester, for example 2-ethylhexyl benzoate, sold under the name Prifer 6813, and a tetramethoxy ether, such as 1,1,2,2-tetramethoxy-ethane and dimethyl 3-methyl glutarate, sold as Rhodiasolv IRIS.

The water-repellent components are preferably present in an amount of less than 20 parts by weight per 100 parts by weight of solvent.

The solvent preferably has a flashpoint above 30° C., more preferably above 60° C.

According to some embodiments, at least two opposite sides may have non-straight profiles, the two profiles together forming complementary coupling means in order to couple two adjacent floor elements to each other.

According to some embodiments, the two pairs of opposite sides may have non-straight profiles, it being true for both pairs that the two profiles of mutually opposite sides together form a set of complementary coupling means to couple two adjacent floor elements to each other.

According to some embodiments, prior to applying the water-repellent cover layer, the straight or non-straight profiles may be formed by milling, punching and/or sawing the sides of the rectangular polymer substrate provided with a decorative top layer.

According to some embodiments, providing a solvent-based cover layer may be achieved by spraying on the solvent-based cover layer or by applying it with a brush or via a transfer roller.

According to some embodiments, the sides of the floor element may be provided with a solvent-based cover layer along the entire length of the sides.

The independent and dependent claims describe specific and preferred characterizing features of the embodiments of the invention. Characterizing features of the dependent claims may be combined with characterizing features of the independent and dependent claims, or with characterizing features described above and/or below, in any suitable way, as will be clear to a person skilled in the art.

The abovementioned and other characterizing features, properties and advantages of the present invention will be explained by means of the following exemplary embodiments, optionally in combination with the drawings.

The description of these exemplary embodiments is given by way of clarification, without having the intention of limiting the scope of the invention. The reference numerals in the following description refer to the drawings. Identical reference numerals in any different figures refer to identical or similar elements.

With a view to providing a better illustration of the characterizing features of the invention, the following text describes a number of preferred embodiments by way of example without any limiting nature, with reference to the attached drawings, in which.

The present invention is described below by means of specific embodiments.

It should be noted that the term "comprising", as used, for example, in the claims, should not be interpreted in a limiting sense, limited to the elements, characterizing features and/or steps mentioned thereafter. The term "comprising" does not exclude the presence of other elements, characterizing features or steps.

Thus the scope of an expression "an object comprising the elements A and B" is not limited to an object which only contains the elements A and B. The scope of an expression "a method comprising the steps A and B" is not limited to a method which only contains the steps A and B.

In the light of the present invention, these expressions only mean that the relevant elements and steps, respectively, are the elements and steps A and B, respectively, for the invention.

In the following specification, reference is made to "an embodiment" or "the embodiment". Such a reference means that a specific element or characterizing feature, described by means of this embodiment, is comprised in at least this one embodiment.

However, the use of the terms "in an embodiment" or "in the embodiment" at various points in this description does not necessarily refer to the same embodiment, although it may nevertheless refer to the same embodiment.

Furthermore, the properties or the characterizing features may be combined in one or more embodiments in any suitable manner, as will be clear to those skilled in the art.

Figure 1:
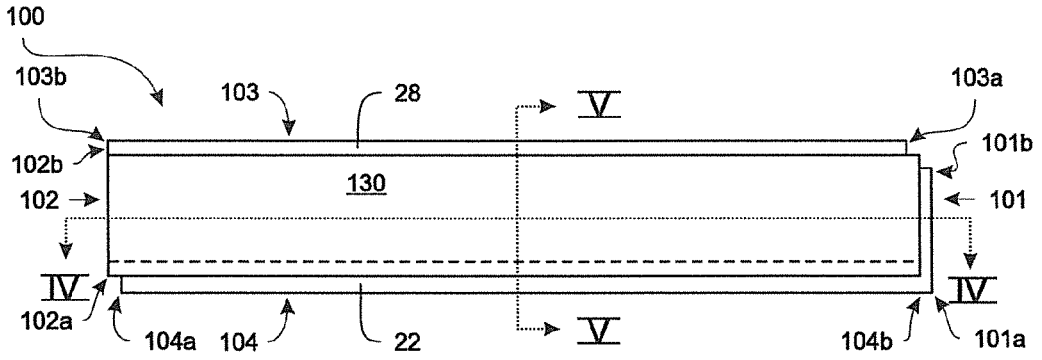
FIG. 1 shows a diagrammatic representation of a top view of a floor element according to the invention.
Figure 2:
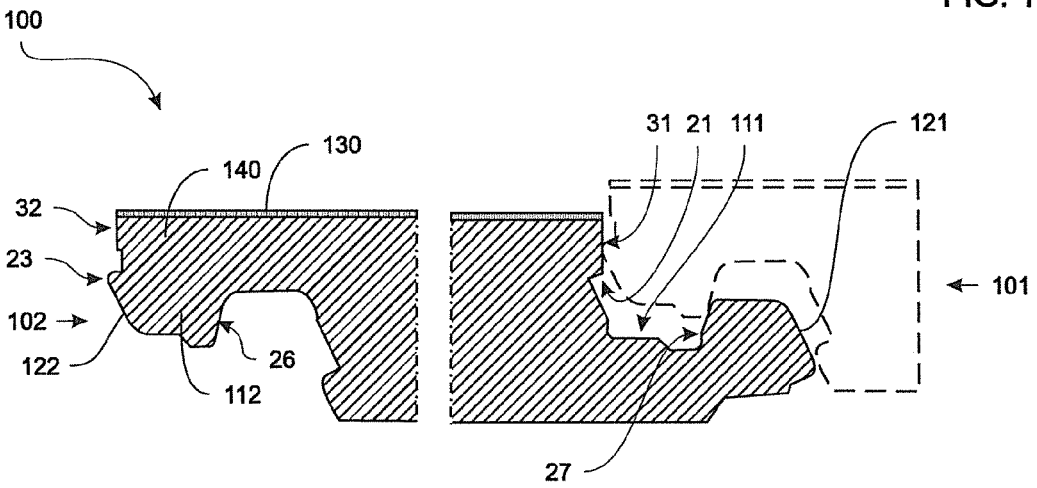
FIGS. 2 and 4 show diagrammatic representations of cross sections along plane IV-IV shown in FIG. 1.
Figure 3:
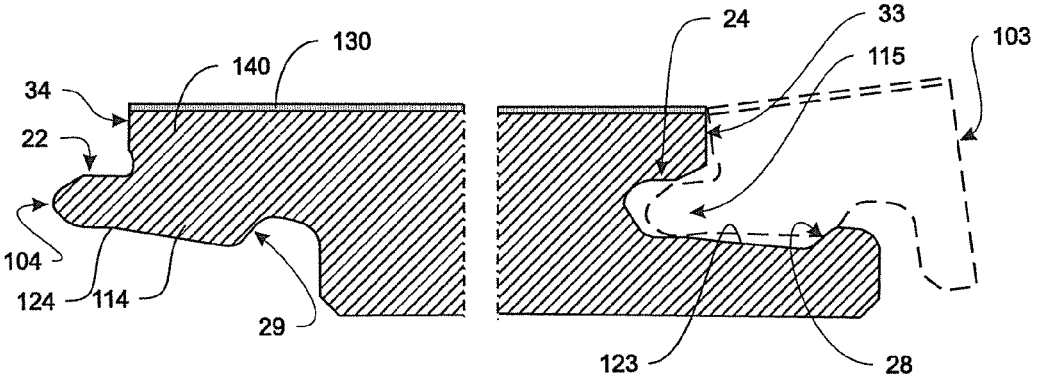
FIGS. 3 and 5 show diagrammatic representations of cross sections along plane V-V shown in FIG. 1.

A floor element according to the invention is diagrammatically shown in FIGS. 1 to 3.

In the cross sections shown in FIGS. 2 and 3, the decorative top layer 130 on the polymer substrate 140 is clearly visible.

The substrate 130 is a rigid PVC layer, i.e. a PVC layer made of hard PVC containing an amount of plasticizer of less than 10 phr. In addition to other additives, such as processing aids, this substrate comprises between 100 and 300 phr, for example 200 phr of fillers, preferably $CaCO_3$. The polymer used is polyvinyl chloride with a K value of between 55 and 60, for example 57. The substrate 130 has a thickness of between 3 and 8 millimeters, for example 4 or 5 mm. One or two glass fiber nonwovens are embedded in this hard PVC, each having a weight per unit area of approximately 35 $g/m^2$.

In an alternative form, this rigid PVC substrate is of the 3-layered ABA type, in which the A layers are formed as described above, where the intermediate B layer is made of similar PVC, but is foamed.

The top layer 140 itself is layered and comprises a PU coating on a wear layer which consists of transparent PVC. This wear layer has a thickness of between 0.1 and 1 mm, for example 0.3 mm. The PVC used does not comprise any fillers, but is semi-rigid PVC containing plasticizers between 25 and 40 phr, for example 30 phr.

Under the wear layer, there is a hard PVC film (containing less than 10 phr of plasticizer) which has a thickness of between 50 and 120 μm (for example 70 μm, 90 μm or 110 m) on which a decoration (for example a wood decoration) is printed. This decor layer is in turn bonded to a layer of soft or semi-soft, typically calendered, PVC. This soft PVC layer has a thickness of 0.6 mm. The PVC preferably comprises 38 phr of plasticizer and 200 phr of fillers, for example $CaCO_3$. This PVC layer makes contact with the substrate 130.

The floor element 100 has four sides which are paired in pairs of two and situated one opposite the other and provided with a profile which offers the possibility of laterally coupling adjacent floor elements. The sides 101 and 102 are parallel to each other and opposite to each other. The tongue 112 of side 102 of a first board can be click-fitted into the groove 111 of side 101 of a second adjoining board by means of a downward movement (fold-down coupling system). The profile 121 of the groove 111 of side 101 cooperates with the profile 122 of the tongue 112 of side 102 in such a way that a horizontal displacement between themselves in the direction at right angles to the side 101 and 102, and a vertical displacement of two floor elements which have been coupled to each other is impossible. The profile sections 21 and 23 prevent the vertical movement, the profile sections 26 and 27 prevent the horizontal movement.

The sides 103 and 104 are parallel to each other and opposite to each other. The tongue 114 of side 104 of a first board can be rotated into the groove 113 of side 103 of a second adjoining board by means of a rotating movement. This is an example of coupling means comprising rotating profiles. The profile 123 of the groove 113 of side 103 cooperates with the profile 124 of the tongue 114 of side 104 in such a way that a horizontal displacement between themselves in the direction at right angles to the side 103 and 104, and a vertical displacement of two floor elements which have been coupled to each other is impossible. The profile sections 22 and 24 prevent the vertical movement, the profile sections 28 and 29 prevent the horizontal movement.

In an alternative embodiment, all sides are provided with a click-fit system.

When click-fitting profiles 121 and 122 to each other, the upright sections 31 and 32 will adjoin each other tightly, if not be pressed against each other by prestress or compressive stress, resulting from the coupling together of the sides. After profiles 123 and 124 have been connected to each other by rotation, the upright sections 33 and 34 will closely adjoin each other, if not be pressed against each other by prestress, resulting from the coupling together of the sides. Thus, prestress may be produced between the adjoining profiles, but this does not necessarily have to be the case. The sides may also be coupled together without prestress.

At least along a part or section of their profile, the sides 101 to 104 of the floor element 100 are coated, preferably at least along the profile sections 31 and 32, and 33 and 34, with a water-repellent coating. The latter is applied along the entire length of the side. Thus, an uninterrupted strip of side which is coated with a water-repellent coating is present between the first end 101*a* and second end 101*b* of the side 101. An uninterrupted strip of side which is coated with a water-repellent coating is present between the first end 102*a* and second end 102*b* of the side 102. An uninterrupted strip of side which is coated with a water-repellent coating is present between the first end 103*a* and second end 103*b* of the side 103. An uninterrupted strip of side which is coated with a water-repellent coating is also present between the first end 104*a* and second end 104*b* of the side 104. Possibly, the entire profiles 121, 122, 123 and 124 are coated with the water-repellent coating.

After a rectangular polymer substrate provided with a decorative top layer has been provided, the profiles 121, 122, 123 and 124 are milled into the sides. These profiles were subsequently provided with a solvent-based cover layer comprising a water-repellent component. The solvent is an organic solvent and the water-repellent component is a fluorocopolymer. The cover layer is applied at a rate of 0.5 to 5 g/m$^2$ by means of spraying or applying with a brush or transfer roller. The cover layer comprises between 50 and 70 vol % of solvent, for example approximately 60 vol % of solvent. Alternatively, a water-based cover layer containing a water-repellent component may be used.

The water-repellent cover layer may optionally furthermore also comprise a pigment or colorant.

After the application, the solvent is removed by drying or evaporation, as a result of which a coating of fluorocopolymer remains behind on the profiles.

In an alternative embodiment, several layers of water-based or organic solvent-based cover layers are applied, optionally using evaporation or drying of the solvent in the interim.

In an alternative embodiment, the decorative top layer is a layer of wood veneer which is bonded to the substrate. The solvent-based cover layer comprising a water-repellent component is certainly applied to the upright edges of the layer of wood veneer in order to thus prevent the wood veneer against ingress of water.

Figure 4:
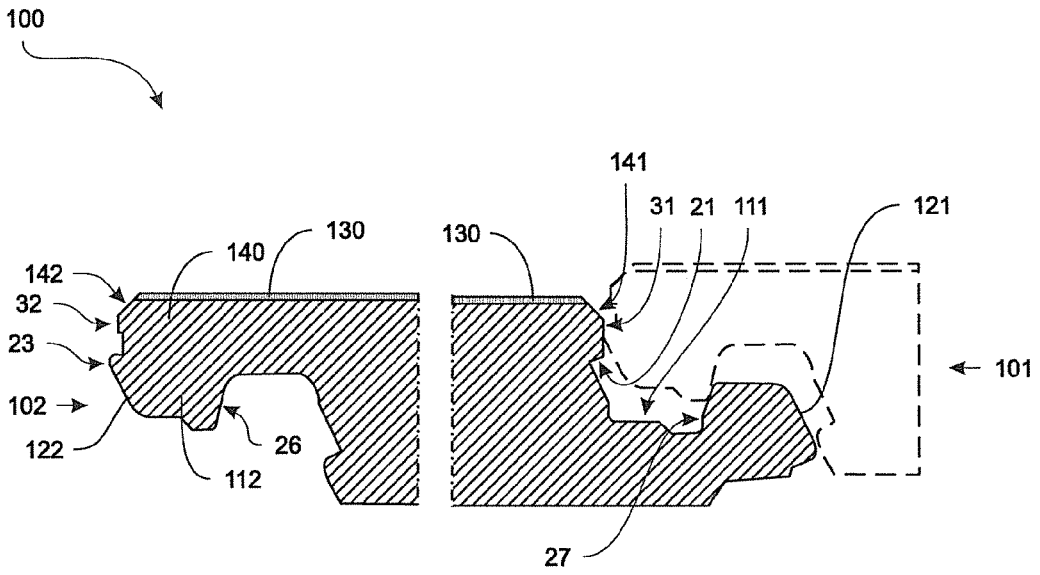
Figure 5:
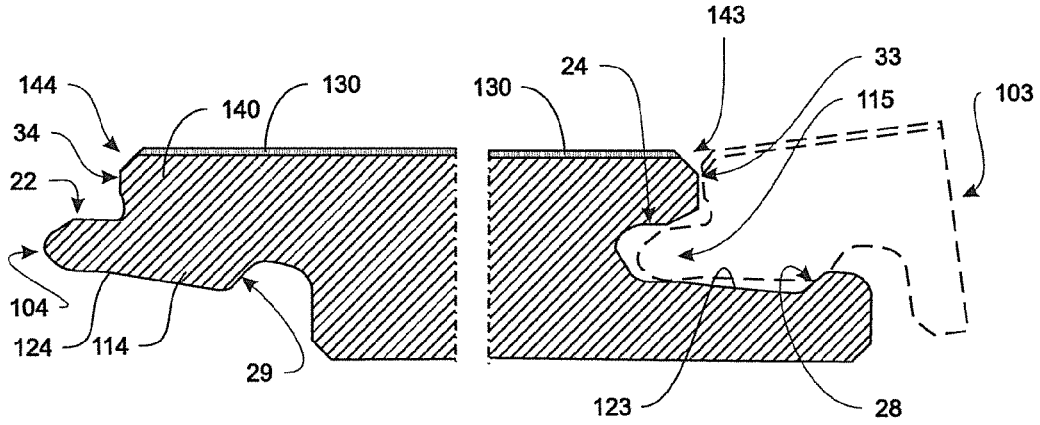

FIGS. 4 and 5 show yet another embodiment.

In this case, the sides 101 to 104 are at least provided with a beveled edge 141, 142, 143 and 144 at the location of the transition of the top layer and the side. The beveled edge 141, 142, 143 and 144 adjoin the upright sections 31 and 32, and 33 and 34. These beveled edges 141 to 144 which thus form part of the profiles 101 to 104 may be but do not necessarily have to be provided with the water-repellent coating. In case the decorative top layer is a layer of wood veneer, these beveled edges are preferably provided with the water-repellent coating, optionally after having first been colored. The beveled edges 141 to 144 may be provided with a layer of paint before the water-repellent cover layer is applied. This layer of paint may be water-based or organic solvent-based. Optionally, the water-repellent cover layer may furthermore also comprise a pigment or colorant.

It will be clear that, although the embodiments and/or the materials for providing embodiments according to the present invention have been described, various modifications or changes may be made without deviating from the area of application and/or the spirit of this invention. The present invention is by no means limited to the above-described embodiments, but may be achieved by means of different variants without departing from the scope of the present invention.

The invention claimed is:

1. A floor element comprising:

a decorative top layer located on a water-resistant polymer substrate, wherein sides of the floor element have a profile along a section with a surface at right angles to the decorative top layer, wherein two opposing sides of the floor element are provided with coupling means configured to couple two adjacent floor elements together, wherein each said opposing side of the floor element is provided with a water-repellent coating along an entire length thereof, and wherein the water-resistant polymer substrate is covered with the water-repellant coating.

2. The floor element of claim 1, wherein the water-repellent coating comprises at least one of epoxy resin, fluoride-functionalized epoxy resin, fluoropolymers, fluorocopolymers, fluoride-functionalized acrylate or combinations thereof.

3. The floor element of claim 1, wherein the water-repellent coating comprises at least one of fluoropolymers or fluorocopolymers.

4. The floor element of claim 1, wherein the substrate comprises polyvinyl chloride (PVC).

5. The floor element of claim 1, wherein one or more of the sides has a straight profile.

6. The floor element of claim 1, wherein the coating is applied along a section of a respective said profile, which section is oriented at right angles to or obliquely to top surface of the floor element.

7. The floor element of claim 1, wherein one or more of the sides has a non-straight profile.

8. The floor element of claim 7, wherein the floor element is substantially rectangular or square, and wherein two pairs of two opposite sides have a non-straight profile.

9. The floor element of claim 8, wherein for both pairs, the two profiles of mutually opposite sides together form a set of said coupling means to couple two adjacent floor elements to each other.

10. The floor element of claim 7, wherein at least one of the sides is provided with at least a beveled edge at location of transition from the top layer to said at least one of the sides.

11. The floor element of claim 10, wherein the coating is applied along the beveled edge.

12. The floor element of claim 10, wherein the coating is applied along a section of a respective profile adjoining the beveled edge.

13. The floor element of claim 7, wherein the floor element is substantially rectangular or square, and wherein at least a first pair of two opposite sides have a non-straight profile.

14. The floor element of claim 13, wherein the first pair of two profiles together form a set of said coupling means to couple two adjacent floor elements to each other.

15. The floor element of claim 14, wherein interacting profiles of the coupling means each have at least a section which adjoin each other during coupling.

16. The floor element of claim 15, wherein at least one or more of the adjoining sections are provided with the water-repellent coating.

17. A floor element comprising:

a decorative top layer located on a water-resistant polymer substrate, wherein sides of the floor element have a profile along a section with a surface at right angles to the decorative top layer, wherein two opposing sides of the floor element are provided with coupling means configured to couple two adjacent floor elements together, wherein each said opposing side of the floor element is provided with a water-repellent coating along an entire length thereof, wherein the water-resistant polymer substrate is covered with the water-repellant coating, and wherein the water-resistant polymer substrate comprises polymers and fillers.

18. The floor element of claim 17, wherein the fillers of the polymer substrate comprise at least one of glass fibers, calcium hydroxide (slaked lime), calcium carbonate, calcium hydrogen carbonate, calcium magnesium carbonate ($CaMg(CO_3)_2$), talcum, or microsphere.

19. The floor element of claim 18, wherein the polymer substrate comprises:

(i) up to 70% by weight of the fillers; and (ii) an amount of about 7 to 10 parts per hundred resin (phr) of plasticizer.

20. The floor element of claim 19, wherein the polymers of the polymer substrate comprise polyvinyl chloride (PVC).

21. A method of manufacturing floor elements, comprising:

providing a rectangular or square water-resistant polymer substrate for a respective said floor element, wherein the water-resistant polymer substrate is provided with a decorative top layer;

providing profiles of sides of the water-resistant polymer substrate with a solvent-based cover layer, furthermore, comprising at least one water-repellent component;

removing solvent from the solvent-based cover layer until a water-repellent coating is obtained;

wherein the sides of the respective floor element have a respective said profile along a section with a surface at right angles to the decorative top layer, wherein two opposing sides of the respective floor element are provided with coupling means configured to couple two adjacent floor elements together, wherein each said opposing side of the respective floor element is provided with the water-repellent coating along an entire length thereof, and wherein the water-resistant polymer substrate is covered with the water-repellant coating.

22. The method of claim 21, wherein the at least one water-repellent component comprises at least one of epoxy resin, fluoride-functionalized epoxy resin, fluoropolymers, fluorocopolymers, fluoride-functionalized acrylate or combinations thereof.

23. The method of claim 21, wherein at least two opposite sides have non-straight profiles, wherein the two non-straight profiles together form a set of said coupling means to couple two adjacent floor elements to each other.

24. The method of claim 21, wherein two pairs of two opposite sides have a non-straight profile, wherein for both pairs, the two non-straight profiles of mutually opposite sides together form said coupling means to couple two adjacent floor elements to each other.

* * * * *